United States Patent [19]

Bako

[11] 4,100,775

[45] Jul. 18, 1978

[54] COMBINATION LOCK

[75] Inventor: Lazlo Bako, Woodcliff Lake, N.J.

[73] Assignee: Presto Lock Company, Division of Walter Kidde & Company, Inc., Garfield, N.J.

[21] Appl. No.: 763,687

[22] Filed: Jan. 12, 1977

[51] Int. Cl.[2] ..... E05B 65/48

[52] U.S. Cl. ..... 70/3; 70/70; 70/312

[58] Field of Search ..... 70/3, 4, 5, 67, 69, 70/70, 71, 72, 73, 74, 75, 76, 312

[56] References Cited

U.S. PATENT DOCUMENTS

| | | | |
|---|---|---|---|
| 3,000,571 | 4/1974 | Heine | 70/71 |
| 3,416,338 | 12/1968 | Gehrie | 70/312 |

*Primary Examiner*—Robert L. Wolfe

*Attorney, Agent, or Firm*—Shapiro and Shapiro

[57] ABSTRACT

A combination lock which employs a plurality of dials and respective sleeve means for each dial has a pivotally mounted bolt member related to the sleeve means so that the bolt member may be pivoted to respective "on combination" and "off combination" positions. A latch member cooperable with the bolt member is mounted for sliding movement in a direction which is perpendicular to the longitudinal axis of the shaft upon which the dials and their respective sleeve means are mounted. Cooperable means are provided by the bolt member and the latch member to block movement of the latch member toward release position when the lock is "off combination". The latch member is provided with means to allow by-passing the bolt member and movement of the latch member to release position when the lock is "on combination". The combination lock is particularly suited for briefcases or the like.

11 Claims, 13 Drawing Figures

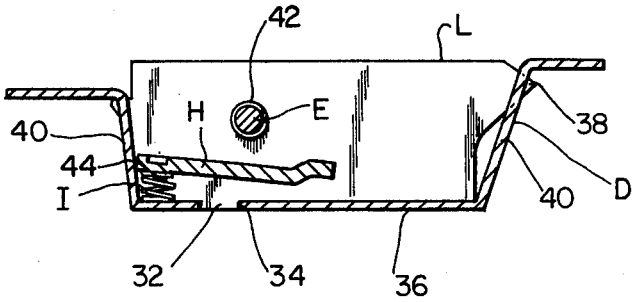
FIG. 7
FIG. 9
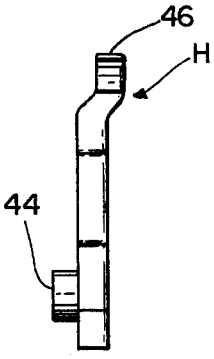
FIG. 8
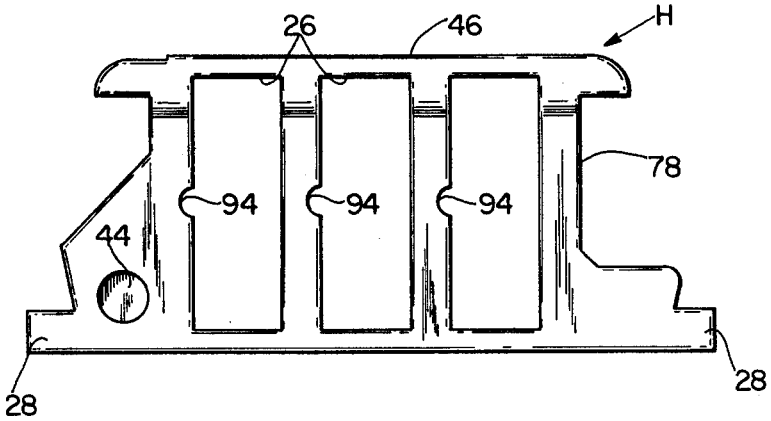
FIG. 10
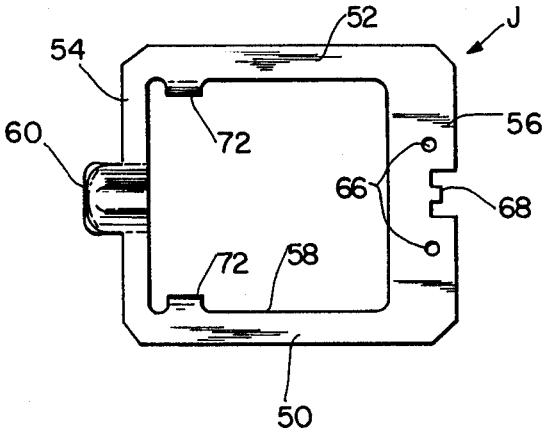
FIG. 11
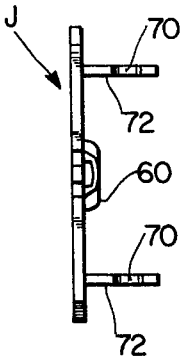

COMBINATION LOCK

The invention relates to combination locks, and is more particularly directed to a combination lock adapted for use on briefcases or the like.

BACKGROUND OF THE INVENTION

Combination or permutation locks are frequently used to secure luggage and attache cases. The combination lock disclosed in U.S. Gehrie Pat. No. 3,416,338; granted Dec. 17, 1968, has enjoyed considerable commercial success for these applications. However, whereas with a combination lock of this type the viewing of the indicia on the rotatable dials is normal and natural when the lock is used for luggage and attache cases, the viewing of the indicia is awkward and unnatural when the lock is used on a briefcase.

For luggage cases and for attache cases, the hasp is secured to one of the hinged sections and the lock to the other section so that when the case is closed, the indicia are upright or horizontally arranged for reading from left to right. This is a natural way to read except in China and Japan. For the briefcase application, the hasp is secured to a flexible member connected to one side of the case for cooperation with the lock secured to the other side of the case. In the combination lock of the aforementioned Gehrie patent, the latch member moves in a direction parallel to the axis of rotation of the dials or in a plane perpendicular to the sides of the dials so that in the briefcase application the indicia on the dials are oriented 90° from the horizontal, and must be viewed sideways. It would seem that the combination lock disclosed in the Gehrie Patent could be modified for use in briefcases by simply repositioning the indicia on the dials 90° so that the indicia would be viewable in upright position. However, this would result in the indicia or numbers being arranged one above the other in a vertical plane. Reading in this manner is unnatural for persons educated in Occidental countries.

U.S. Heine Pat. No. 3,800,571; granted Apr. 2, 1974, discloses a combination lock in which the hasp is positioned for engagement with a latch member in the context of a pivotally mounted bolt member which is cooperable with the latch member. The position of the bolt member is responsive to the position of sleeve means related to the dials for the "on combination" and "off combination" conditions of the lock. The bolt member and the latch member are constructed for interlocking engagement in the "off combination" of the lock, and the latching member is spaced longitudinally from the dials. This combination lock has the same limitation as the lock disclosed in the aforementioned Gehrie Patent in that it is not suitable for use in a briefcase or the like; the indicia on the dials are not suitably oriented, and merely changing the orientation of the indicia on the dials would not cure the situation.

SUMMARY OF THE INVENTION

The primary object of the invention is to provide an improved combination lock which is particularly adapted for use in briefcases or the like in the respect that the lock is constructed so that the indicia are upright for easy reading when the lock is mounted on a briefcase or the like.

A combination lock constructed in accordance with the invention is cooperable with a hasp and comprises a shaft, dials having indicia thereon, sleeve means for each dial on the shaft, each sleeve means having a flange and a flat portion, a slotted bolt member having the dials extending therethrough adjacent the sleeve means, means pivotally mounting the bolt member, and resilient means urging the bolt member against the sleeve means. A latch member is mounted for sliding movement in a plane perpendicular to the longitudinal axis of the shaft, or in a plane that is perpendicular to the periphery of the dials having the indicia thereon. The latch member, which is spring mounted, is movable between a latching position where the latch member is engageable with the hasp and a release position. Cooperable means are provided by the bolt member and the latch member to block movement of the latch member toward release position when a flange engages and pivots the bolt member against the force of the resilient means acting on the bolt member (off combination). Means is provided by the latch member to allow the latch member to by-pass the bolt member and permit movement of the latch member to release position when all flat portions on the sleeve means are in engagement with the bolt member (on combination).

The latch member is related to the various parts of the lock and particularly with respect to the bolt member so that the latch member overlies the bolt member. In this way, the lock is compact, as well as rugged and very effective in use.

These, and other advantages and improved results furnished by the combination lock of the invention will be apparent from the following detailed description of an illustrated and preferred embodiment of the invention.

BRIEF DESCRIPTION OF THE DRAWINGS

FIG. 7 is a view taken approximately in the plane of line 7—7 of FIG. 6;

FIG. 8 is a top plan view of the bolt member component of the assembly;

FIG. 9 is a side view of the bolt member;

FIG. 10 is a top plan view of the latch member;

FIG. 11 is a side view of the latch member;

DESCRIPTION OF THE PREFERRED EMBODIMENT

Figure 1:
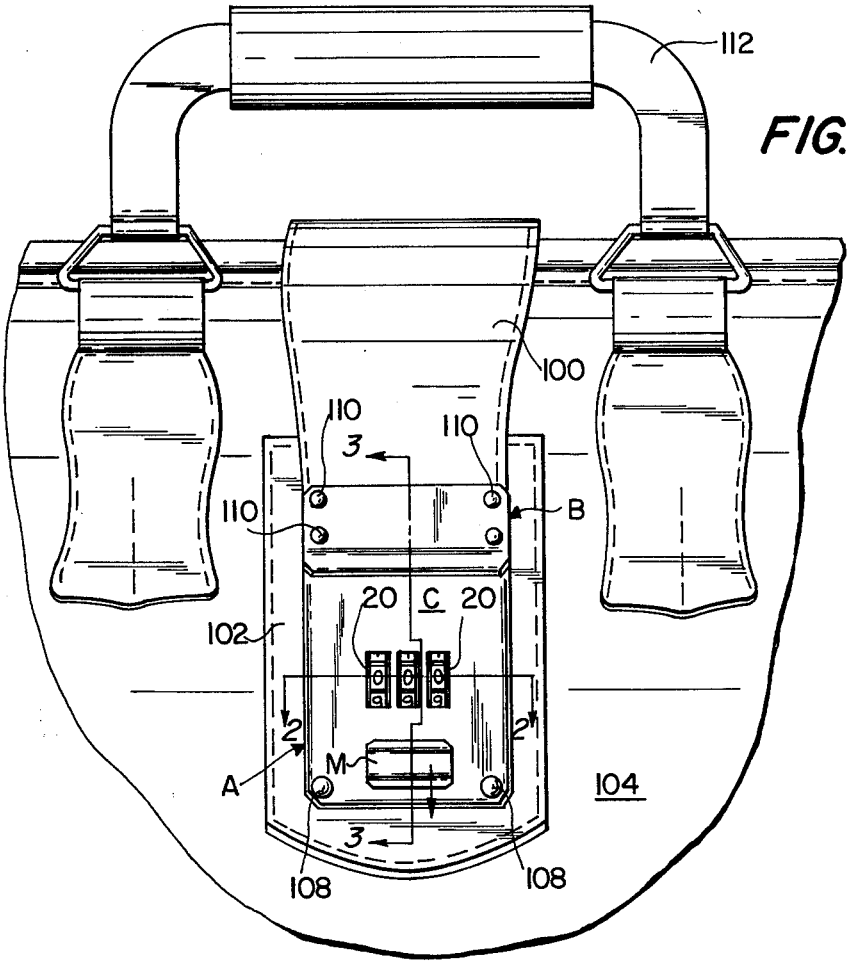
FIG. 1 is a top plan view of a combination lock made in accordance with the invention, the lock being shown in association with the hasp, this view also showing the lock and hasp as secured, for example, to a briefcase, which is partially shown.

Referring to the drawings, a combination lock A made in accordance with the invention is cooperable with a hasp B. Generally, the combination lock A comprises a face plate C, a frame D, a shaft E, dials F, sleeve means G, a bolt member H, resilient means I acting upon the bolt member, a latch member J, and resilient means K acting upon the latch member to urge it toward latching position.

Figure 2:
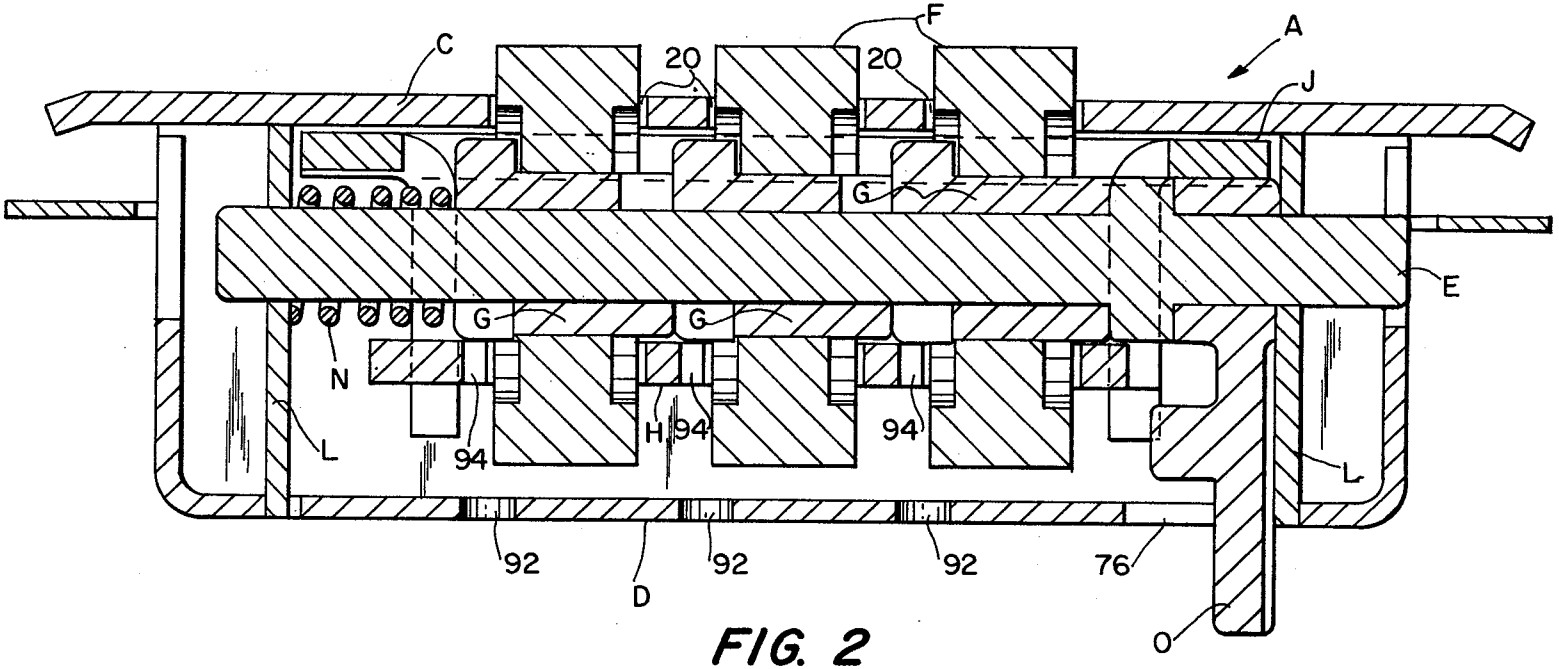
FIG. 2 is an enlarged transverse, vertical cross-sectional view taken approximately in the plane of line 2—2 of FIG. 1.
Figure 13:
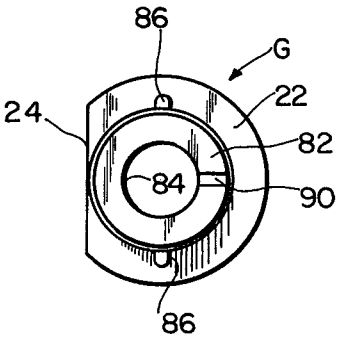
FIG. 13 is a side elevational view of one of the sleeves.
Figure 3:
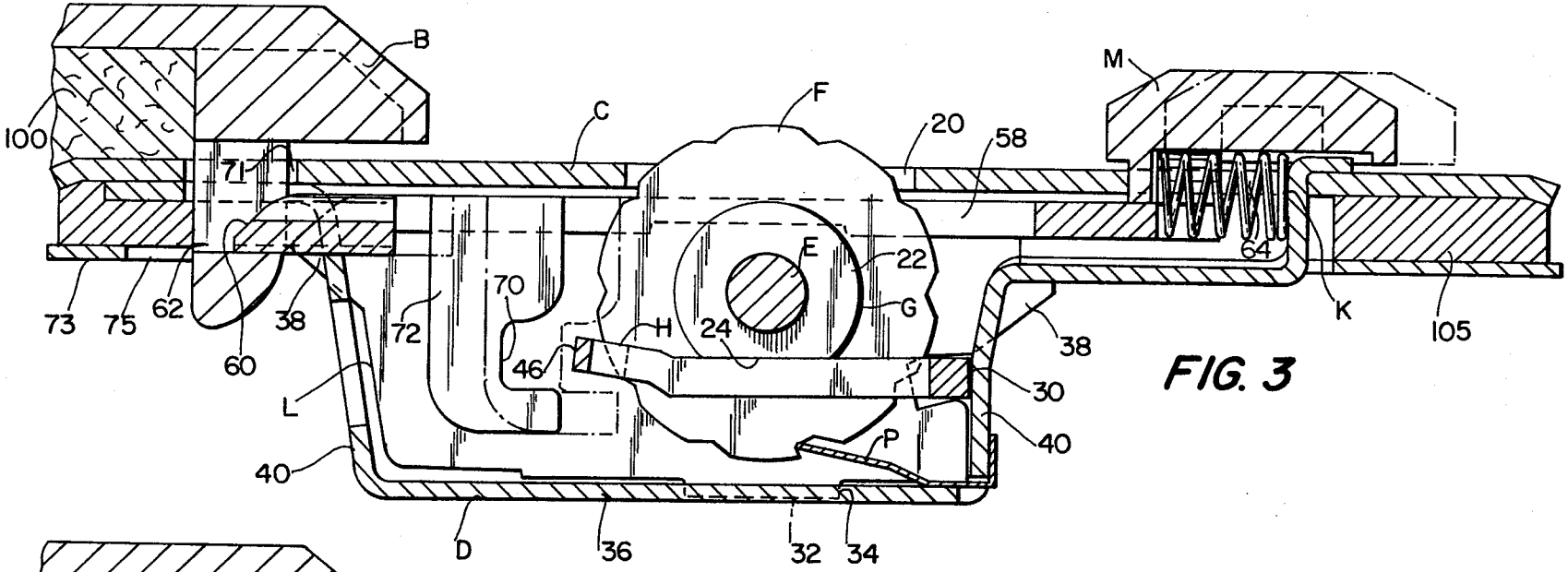
FIG. 3 is an enlarged longitudinal, vertical cross-sectional view taken approximately in the planes of lines 3—3 of FIG. 1.
Figure 4:
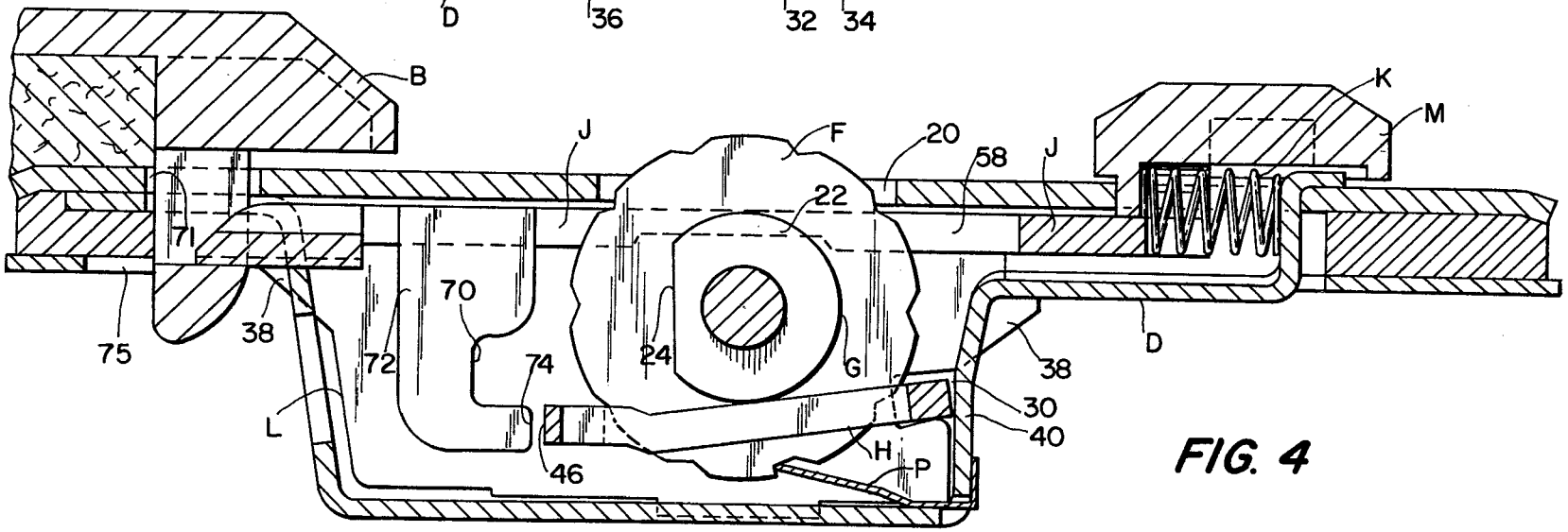
FIG. 4 is a view similar to FIG. 3, this view showing the lock in the "off combination" condition.

As shown in FIGS. 1–4, the face plate C is provided with a plurality of aligned transversely spaced slots 20. The shaft E is related to the face plate so that the dials F are positioned to extend partially through the slots and the sleeve means G for each dial are mounted on the shaft. As shown in FIGS. 3, 4 and 13, each sleeve means has a flange portion 22 and a flat portion 24.

Referring to FIGS. 2 and 8, the bolt member H is provided with a plurality of spaced slots 26 to permit the dials F to be extended therethrough. The bolt member is positioned adjacent the sleeve means G, and is pivotally mounted to rock or rotate on an axis extending parallel to the longitudinal axis of the shaft E. The means for pivotally mounting the bolt member extends along one side of the bolt member. The frame D is formed to encompass the mechanism with dials F and sleeve means G mounted on the shaft E, the bolt member H and the latch member J, and the frame is connected to the face plate C. The bolt member H is engaged by the resilient means I (FIG. 7) which acts to urge the bolt member against the sleeve means G.

The latch member J is mounted for sliding movement in a plane perpendicular to the longitudinal axis of the shaft E. Stated in another way, the latch member is movable in a plane or direction that is perpendicular to the periphery of the dials having the indicia thereon. Such movement will be evident from a viewing of FIG. 3 wherein the position of the latch member in the latching position is shown in solid line, and its position in release position is shown in the dot-dash phantom lines. Also as shown in FIG. 3, the latch member is positioned to underlie the face plate and to overlie the bolt member H.

The bolt member H provides means to block movement of the latch member toward release position when a flange 22 of a sleeve means G engages and pivots the bolt member H against the force of the resilient means, as shown in FIG. 4. The latch member J provides means to allow by-passing the bolt member H and to permit movement of the latch means to release position when all flat portions 24 are in engagement with the bolt member. This action will be evident from a comparison of the solid line and dot-dash line positions of the latch member shown in FIG. 3.

Figure 6:
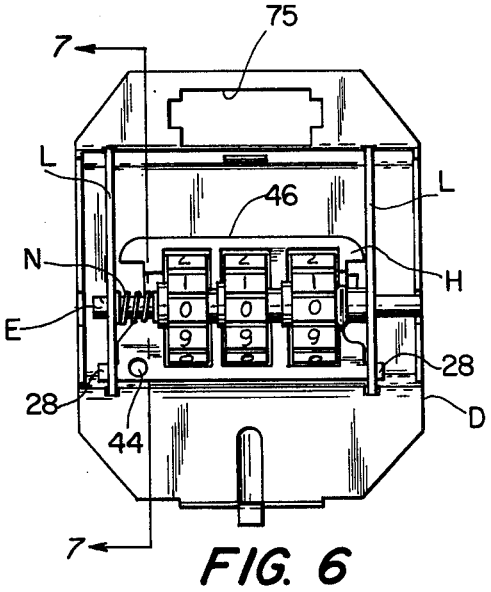
FIG. 6 is a top plan view of the combination lock with the face plate and latch member removed for clarity in illustration.

In greater detail, the slotted bolt member H is provided along one side with a pair of oppositely extending trunnions 28 (FIG. 8). The trunnions are journaled in openings 30 (FIGS. 3 and 4) provided in a pair of transversely spaced brackets L (FIGS. 3 and 6). The brackets are each secured within the frame D by having a projection 32 extended through an opening 34 with a close fit in the underside 36 of the frame. The sides of each bracket L are secured in place by providing them with oppositely extending projections 38 near the top of the bracket and extended through close fitting openings formed in the sides 40 of the frame. As shown in FIG. 7, each bracket L is also provided with an opening 42 for supporting the ends of the shaft E. Along the side having the trunnions, the bolt member H is provided with a dimple 44 which is received within the coiled compression spring I, the opposite end of the spring bearing against the bottom wall 36 of the frame D. The edge 46 of the bolt member opposite the side where the trunnions 28 are located or the side where the bolt member is pivoted is cooperable with the latch member J to block movement of the latch member or to lock the device when the device is "off combination" (FIG. 4).

As shown in FIGS. 10 and 11, the latch member J comprises a generally rectangular member having parallel first and second side webs 50 and 52 and parallel first and second end webs 54 and 56 defining a central opening 58. As shown in FIGS. 3 and 4, the dials F extend through the opening 58. A nose 60 extends from the first web 54 for cooperation with the hasp B. As shown in FIGS. 3 and 4, the hasp is provided with an opening 62 to receive the nose 60 of the latch member. A puller M is connected to the second web 56 to enable moving the latch member from its latching position to release position. The latch member (and the puller) are normally maintained in latching position by the resilient means K in the form of a coiled spring. The puller is connected to the latch member to maintain the latch member close to the underside of the face plate C. This is accomplished by providing the puller with transversely spaced connecting studs (not shown) which are extended through an opening 64 in the face plate (FIG. 3) and through aligned transversely spaced openings 66 in the end web 56 of the latch member and then swaging over the ends of the connecting studs to secure the puller to the latch member.

As shown in FIGS. 1, 3 and 4, the puller M is exposed on the face plate so that it may be manually grasped to impart sliding movement to the latch member J. The latch member is provided with a projection 68 (FIG. 10) for locating the coiled spring K, one end of which bears against the latch member, the other end bearing against an adjoining portion of the frame. The latch member normally is biased by the spring K toward hasp engaging or latching position as shown by the solid line position of the latch member in FIG. 3. The latch member is confined at its sides by the brackets L for the sliding movement between latching and release positions.

When the lock is "on combination"; that is, when all of the sleeve means are oriented so that their flat portions 24 are facing the bolt member H, as shown in FIG. 3, then the latch member may be retracted to release position; the nose 60 of the latch member is disengaged from the opening 62 in the hasp B. Such movement may take place because, as shown in FIG. 3, the bolt member H, or the front edge 46 thereof is in alignment with means 70 provided by the latch member to allow by-passing the bolt member and permitting movement of the latch member to release position, the dot-dash position of the latch member. As shown, a notch 70 is provided in a projection 72 which extends from the latch member. The projection depends from the underside of one of the side webs near the end web 54. While one projection including a notch is sufficient, it is preferred that a pair of projections and notches be used for symmetry and strength, as shown in FIGS. 10 and 11. When the lock is in "off combination" condition as shown in FIG. 4, then the bolt member H or the forward edge 46 thereof is in alignment with a portion 74 of the projection 72 to block movement of the latch member toward release position to thereby lock the device.

The described shaft, dials, sleeve means, bolt member, latch member, resilient means for the bolt member and for the latch member, and the brackets are enclosed between the face plate C and the dished frame D which are connected to each other. The face plate has an opening 71 to allow passage of the projection on the hasp having the opening 62. The frame has a wall 73 which extends horizontally, the wall having an opening 75 which is aligned with the opening 71 when the face plate and frame are connected. The frame and face plate are connected to one another by any suitable means, such as by tangs formed on the face plate at the edges of the opening 71 which are bent over and under the portions adjoining the opening 75 in the frame at one end of the assembly. At the other end of the assembly a tang may be provided on the frame which is received within an opening provided in the face plate beneath the puller where such connection is not visible.

It is within the scope of the invention to make the sleeve means G integral with the respective dials F. In such case, the combination would be set at the factory. In the preferred form of the invention, and as illustrated, the sleeve means are each in the form of a sleeve separate from each dial. Sleeves and dial are made with cooperable means for releasably keying them together to permit the selection of a combination of one's own secret choice. With separate sleeves formed for releasable keying to the dials, a spring N is provided around the end of the shaft E to which a lever O is secured or mounted, as shown in FIG. 2. Spring N serves to maintain the individual sleeves in abutting, end-to-end relationship, and the lever O, which is rotatably mounted on the shaft E and which extends through a cut-out or opening 76 in the frame D, may be rotated and pushed against the force of the spring N to disengage the sleeves from their respective dials to then enable the dials to be rotated to a selected combination of one's choice. Where the preferred sleeve means are in the form of individual sleeves for keying to the dials, the bolt member H also is provided with a cut-out or opening 78 to allow the lever to extend therethrough.

Figure 12:
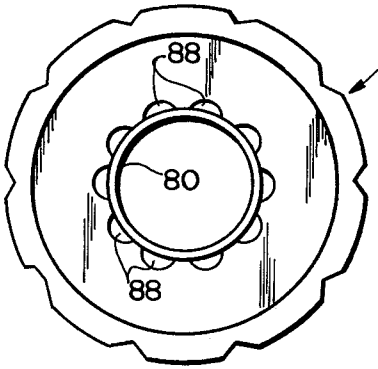
FIG. 12 is a side elevational view of one of the dials.

Where, as preferred, the sleeve means and dials are separate, cooperable elements, it is preferred that these elements be structured as described in the aforementioned Gehrie U.S. Pat. No. 3,416,338. As shown in FIGS. 12 and 13 herein, each dial F has a central opening 80 through which the shank 82 of a sleeve G may be extended with a slight amount of clearance (FIG. 2). The sleeve has a central bore 84 of a diameter slightly greater than the diameter of a shaft E. At one end thereof, each sleeve is provided with the aforementioned flange 22 having a larger diameter than the central opening 80 of a dial. The flanged end of the sleeve is provided with the flat portion 24. At the juncture of the flange and the sleeve's shank, a detent or dentents 86 are provided. On one side of each dial, circumferentially arranged detent receiving recesses 88 are provided adjacent the opening 80, there being one recess in alignment with each number on the dial's outer circumference. The recesses 88 extend only partially into the side wall of the dial and are adapted to receive the detents 86, whereby a dial in the sleeve may be keyed or meshed to one another. A dial cooperable spring P is related to the dials so that the dials are releasably maintained in selected circumferential position.

In the illustrated form of the invention, there are three separate sleeves in three dials. With three dials each having ten indicia or numbers thereon, there are 1,000 different possible combinations available. It will be understood that any desired number of dials may be used to furnish the desired number of combinations.

Figure 5:
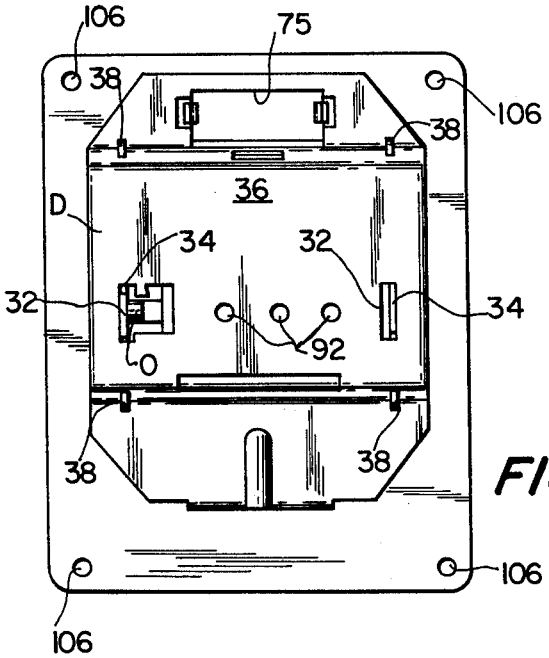
FIG. 5 is a rear plan view of the lock.

Also, in the preferred and illustrated form of the invention, the combination lock is provided with visual indicator means as disclosed in the aforementioned Gehrie Pat. No. 3,416,338. For this purpose, the sleeves are provided with visual or feeler means 90 for alignment with openings 92 in the frame D, as shown in FIGS. 2 and 5. To allow access to the slot or visual means on the sleeves, the blot member also is provided with aligned notches 94 (FIG. 8).

As hereinbefore indicated, the combination lock as herein described is particularly adapted for use in briefcases or the like. Such use is shown in FIG. 1 where the lock A is secured to one side of a briefcase and the hasp B is secured to a flap 100 connected to the other side of the case. As is common in this field, the lock is mounted on a reinforcing pad 102 which in turn is sewn to the side 104 of the briefcase. A washer 105 may be provided under the face plate C. The connection of the lock to the case may be made in any suitable manner, as by providing the corners of the face plate C with openings 106 through which rivets 108 are passed and headed over on the underside. The ends of the rivets are covered by a piece of leather on the underside. Also, the back of the lock is provided with a flap which may be lifted to allow access to the lever O to enable one to change the combination to a combination of one's own choice. The pad and the wall of the case have aligned openings to allow such access. The hasp also is provided with openings to allow rivets 110 to be extended therethrough and into the flap 100 to enable the connection of the hasp to the flap. It will be apparent from a viewing of FIG. 1, that the indicia on the dials are upright and may be read in the normal manner with ease. To open the case and when the dials are "on combination", it is only necessary to move the puller in the direction of the arrow whereupon the latch member will be disengaged from the hasp allowing the flap to be lifted.

It is believed that the advantages and improved results afforded by the combination lock of the invention will be apparent from the foregoing detailed description of a preferred embodiment thereof. Various changes and modifications may be made to the preferred embodiment of the invention as hereinbefore described without departing from the spirit and scope of the invention as sought to be defined in the following claims.

I claim:

1. A combination lock cooperable with a hasp, the combination lock comprising a shaft, dials having indicia thereon, sleeve means for each dial on the shaft, each sleeve means having a flange and a flat portion, a slotted bolt member having the dials extending therethrough adjacent the sleeve means, means pivotally mounting the bolt member, resilient means urging the bolt member against the sleeve means, a latch member mounted to overlie the bolt member for sliding movement in a plane perpendicular to the longitudinal axis of the shaft between a latching position where the latch member is engageable with the hasp and a release positon, means provided by the bolt member and cooperable means provided by the latch member to block movement of the latch member toward release position when a flange engages and pivots the bolt member against the force of the resilient means, and means provided by the latch member to allow by-passing the bolt member and movement of the latch member to release position when all flat portions are in engagement with the bolt member.

2. A combination lock according to claim 1, wherein the means provided by the bolt member is the edge of the bolt member opposite the side which is pivotally mounted and the means provided by latch member cooperable therewith is a projection extending therefrom.

3. A combination lock according to claim 2, wherein the means provided by the latch member to allow by-passing the bolt member and movement of the latch member to release position comprises a notch in the projection for alignment with the bolt member when the flat portions of the sleeve means are in engagement with the bolt member.

4. A combination lock according to claim 1, including a face plate having transversely spaced slots, the dials being positioned in the slots, the latch member being positioned immediately on the underside of the face plate and connected thereto for sliding movement by a puller on the upper side of the face plate, resilient means normally urging the latch member toward latching position, and a frame connected to the face plate.

5. A combination lock according to claim 3, including a face plate having transversely spaced slots, the dials being positioned in the slots, the latch member being positioned immediately on the underside of the face plate and connected thereto for sliding movement by a puller on the upper side of the face plate, resilient means normallly urging the latch member toward latching position, and a back cover connected to the face plate.

6. A combination lock according to claim 1, wherein the latch member comprises a generally rectangular member having first and second side webs and first and second end webs defining a central opening, the dials extending through the opening, a nose extending from the first end web cooperable with the hasp, a puller connected to the second end web, and a projection depending from one of said side webs and constituting the means cooperable with the bolt member to block movement of the latch member toward release position when a flange engages and pivots the bolt member.

7. A combination lock according to claim 6, wherein the projection has a notch for alignment with the bolt member to allow by-passing the bolt member and movement of the latch member.

8. A combination lock according to clam 7, including a face plate having transversely spaced slots, the dials being positioned in the slots, the latch member being positioned immediately on the underside of the face plate and connected thereto for sliding movement by the puller on the upper side of the face plate, resilient means normally urging the latch member toward latching position and a frame connected to the face plate.

9. A combination lock according to claim 1, wherein the sleeve means are separate sleeves, the dials and sleeves each being provided with cooperable means for keying a sleeve to a respective dial, a spring for normally keying the sleeves to their respective dials, and means for disengaging the sleeves from the dials to permit changing the combination.

10. A combination lock according to claim 3, wherein the sleeve means are separate sleeves, the dials and sleeves each being provided with cooperable means for keying a sleeve to a respective dial, a spring for normally keying the sleeves to their respective dials, and means for disengaging the sleeves from the dials to permit changing the combination.

11. A combination lock according to claim 8, wherein the sleeve means are separate sleeves, the dials and sleeves each being provided with cooperable means for keying a sleeve to a respective dial, a spring for normally keying the sleeves to their respective dials, and means for disengaging the sleeves from the dials to permit changing the combination.

* * * * *